US007806569B2

(12) United States Patent
Sanroma et al.

(10) Patent No.: US 7,806,569 B2
(45) Date of Patent: Oct. 5, 2010

(54) LIGHTING SYSTEM WITH REMOVABLE LIGHT MODULES

(75) Inventors: John P. Sanroma, Billerica, MA (US); John D. Mitchell, Jr., Andover, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 11/904,742

(22) Filed: Sep. 28, 2007

(65) Prior Publication Data

US 2009/0086478 A1 Apr. 2, 2009

(51) Int. Cl.
*F21V 21/00* (2006.01)

(52) U.S. Cl. ..... 362/398

(58) Field of Classification Search ..... 362/398
See application file for complete search history.

(56) References Cited

U.S. PATENT DOCUMENTS 2,380,636 A * 7/1945 Drumm ..... 362/158
4,719,549 A 1/1988 Apel
5,154,509 A 10/1992 Wulfman et al.
5,575,459 A * 11/1996 Anderson ..... 362/240
5,806,966 A * 9/1998 Crowder et al. ..... 362/253
5,816,696 A 10/1998 Beisler
6,089,884 A 7/2000 Klaus
6,577,512 B2 6/2003 Tripathi et al.
7,374,311 B2 * 5/2008 Rains et al. ..... 362/234
2001/0048595 A1 * 12/2001 Richardson ..... 362/92

* cited by examiner

*Primary Examiner*—Jason Moon Han
(74) *Attorney, Agent, or Firm*—Joseph Romanow; Shaun P. Montana

(57) ABSTRACT

A lighting system with removable light modules mounted on a frame by an attractive force between magnetic material of the light module and magnetic material of the frame such that a light module may be installed on, removed from, or relocated on the frame manually without tools or permanent electrical connection. The frame may be one-, two-, or three-dimensional, and it may provide an aesthetic appearance even when the lighting system is not illuminated. The light modules may employ incandescent, quartz-halogen, LED, or fluorescent light sources. Particularly, in LED embodiments, the magnetic materials serve the dual functions of mounting and heat sinking. The lighting system may be utilized as a sign, signaling device, or a building block in larger lighting systems. The lighting system has a wide variety of applications and provides a user with improved ability to control the quantity, direction, and characteristics of the emitted light.

12 Claims, 10 Drawing Sheets

LIGHTING SYSTEM WITH REMOVABLE LIGHT MODULES

BACKGROUND OF THE INVENTION

1. Field of the Invention

This invention relates to lighting systems and more particularly to lighting systems having manually insertable and removable light modules such that the quantity, direction, and/or characteristics of the light emitted from the system may readily be varied.

2. Background Art

In modern lighting systems, it is desirable to have a great deal of flexibility in the user's ability to control the quantity, direction, and characteristics of the light emitted from the system. In theater settings, one is accustomed to observing a number of light fixtures capable of directing light of varying intensities, color, and other characteristics onto the stage. In commercial settings, adjustable reflector lamps and track lights are frequently employed to illuminate merchandise or displays. In office and residential settings, track lights are typically used to direct light to a particular work area or for visual effect. While these systems are flexible, they have disadvantages. One disadvantage is that they are relatively large in the sense that the light fixtures are conspicuous. In many applications, such as in a display case for jewelry or other fine wares, it is desirable for the lighting system to be as inconspicuous as possible. In applications where the appearance of the lighting system itself contributes to its overall aesthetics, there are additional design and production costs. Another disadvantage is that while these systems are flexible, they may be cumbersome to adjust for different lighting requirements. In many cases, the light fixtures are relatively heavy. To move, add, or remove a light fixture with a mechanical connector, a tool may be required and, in some cases, a new electrical connection may be required. Even where the light fixture may be rotatably mounted, the base of the light fixture typically is moveable only in a single dimension. Lastly, there is the disadvantage that these systems are relatively costly.

U.S. Pat. No. 5,154,509, issued on Oct. 13, 1992, to Wulfman et al., describes a low-voltage track lighting system wherein the light fixture is mounted on the track by means of magnetic force, and electrical power is conveyed from the track to the fixture by means of physical contacts between the electrical leads of the track and fixture. Wulfman et al. teaches a conventional track-lighting system, i.e., a number of light fixtures movably mounted on a linear track. The light fixtures of Wulfman et al. are mounted on a triangular bracket. Electrical power is transmitted from the bracket to the housing of the fixture by means of electrical contacts located on two sides of the triangular bracket and two sides of the matching angular recess of the housing. The track and light fixtures of Wulfman et al. are purely functional in design, ie., to provide and direct light.

BRIEF SUMMARY OF THE INVENTION

It is therefore an object of the invention to obviate the deficiencies of the prior art.

Another object of the invention is to enhance lighting systems and a user's ability to control lighting systems.

Still another object of the invention is to provide a lighting system that can employ incandescent, quartz-halogen, LED, and fluorescent light sources.

A further object of the invention is to provide a lighting system capable of being fabricated into numerous three-dimensional solid shapes, e.g., parallelepipeds, spheres, polyhedra.

These objects are accomplished, in one aspect of the invention, by provision of a lighting system with removable light modules. The frame has a substantially flat surface and includes a magnetic material and first and second electrically conductive channels. The removable light module includes a light source mounted on a base. The base has a substantially flat surface and includes a magnetic material and first and second electrically conductive paths. The light source has first and second lead-in wires electrically connected to the first and second electrically conductive paths of the base.

The light module is mounted on the frame with the substantially flat surface of the module's base facing the substantially flat surface of the frame such that the light module is securely mounted on the frame by means of a magnetic attractive force acting between the magnetic material of the module and the magnetic material of the frame and such that the magnetic attractive force permits the light module to be manually removed from the frame.

DETAILED DESCRIPTION OF THE INVENTION

For a better understanding of the present invention together with other and further objects, advantages, and capabilities thereof, reference is made to the following disclosure and appended claims taken in conjunction with the above-described drawings.

For purposes herein, the following definitions apply. A "removable light module" means a light module that may be mounted on, removed from, or relocated on the frame manually without use of tools or need for permanent manipulated electrical connections, such as a connection made with a screw, splice, wire nut, etc. The term "magnetic material" means a material that is either a permanent magnet or a material that is strongly attracted by a permanent magnet. A phrase stating that an article is mounted on a surface of an object includes an arrangement wherein the article is mounted within the object such that a surface of the article comprises or coincides with a portion of the surface of the object. The term "LED" means light-emitting diode, and the term "LED" may include a current-limiting resistor electrically connected in series with the light-emitting diode. The term "low voltage" means about twenty-four volts or less; the term "high voltage" means a voltage other than low voltage. The term "electrical polarity" or "polarity" means the direction in which a direct current flows, and the term "opposite polarity" or "different polarity" means the direction opposite to that in which a direct current flows.

Figure 1:
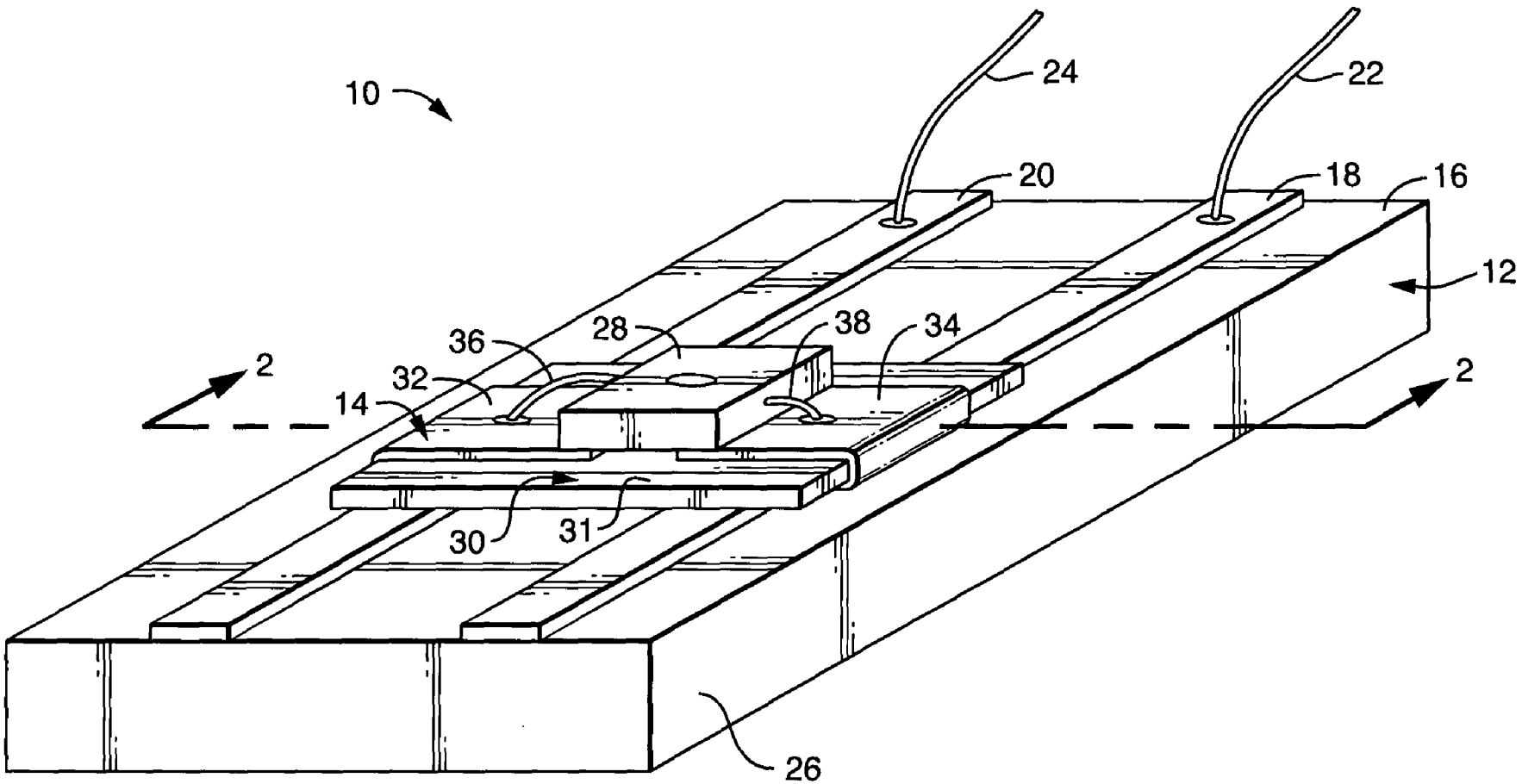
FIG. 1 is a pictorial view of a lighting system in accordance with an embodiment of the invention.

Referring now to the drawings with greater particularity, it should be noted that the orientation of the invention and emitted light shown in the drawings are by way of example and not limitation. In many applications, the light will be emitted substantially downward. FIG. 1 shows lighting system 10 comprising a frame 12 and a removable light module 14. Frame 12 may be formed entirely from a magnetic material, such as iron, or from a non-magnetic material, such as plastic, with one or more pieces of magnetic material imbedded in it. In embodiments where the frame material is electrically conductive, dielectric coating 16 (shown in more detail in FIG. 2) may be used to insulate electrically conductive channels 18 and 20 from each other and from body 26 of the frame. Electrically conductive channels 18 and 20 are thin electrically conductive strips, e.g., copper foil. Terminals 22 and 24 provide means for connecting lighting system 10 to an external source of electrical power. Where the frame is electrically conductive, the frame may serve as one of the electrically conductive channels, e.g., ground, particularly in low-voltage applications.

Light module 14 has light source 28 mounted on base 30. Light source 28 has lead-in wires 36 and 38 connected to electrically conductive paths 32 and 34 that make physical and electrical contact with channels 20 and 18, respectively, of frame 12. In various aspects of the invention, light source 28 will be replaceably mounted on the base such that the light source, e.g, a light bulb, may be replaced at its end of life. As discussed above, dielectric coating 31 (shown in more detail in FIG. 2) may be used to insulate electrically conductive paths 32 and 34 from each other and from base 30. Electrically conductive paths 32 and 34 are formed from thin electrically conductive material, e.g., copper foil. Base 30 may be formed entirely from a magnetic material, such as iron, or from a non-magnetic material, such as plastic, with one or more pieces of magnetic material imbedded in it. The magnetic material of frame 12 may be a permanent magnet that attracts the magnetic material of base 30 or, conversely, the magnetic material of base 30 may be a permanent magnet that will attract the magnetic material of frame 12. In either case, the magnetic attraction between light module 14 and frame 12 must be of sufficient strength to hold module 14 securely on frame 12 while still permitting the module to be mounted on, removed from, or relocated on frame 12 manually without use of tools or need for permanent electrical connections. In the embodiment shown in FIG. 2A, electrically conductive frame 12 serves as one electrical channel. Ridge 21 of body 26 of frame 12 is in physical and electrical contact with path 32 (thereby obviating the need for channel 20 that is electrically isolated from body 26 as depicted in FIG. 2).

A flex circuit including channels 18 and 20 may serve as frame 12. The flex circuit with pressure-sensitive thermally conductive adhesive may be applied to any magnetic substrate material without dielectric treatment. The dielectric strength will be provided by the flex circuit material. This type of frame is particularly well suited for mounting under a sheet metal shelf or cabinet or the like or on a flex magnetic strip.

Figure 2:
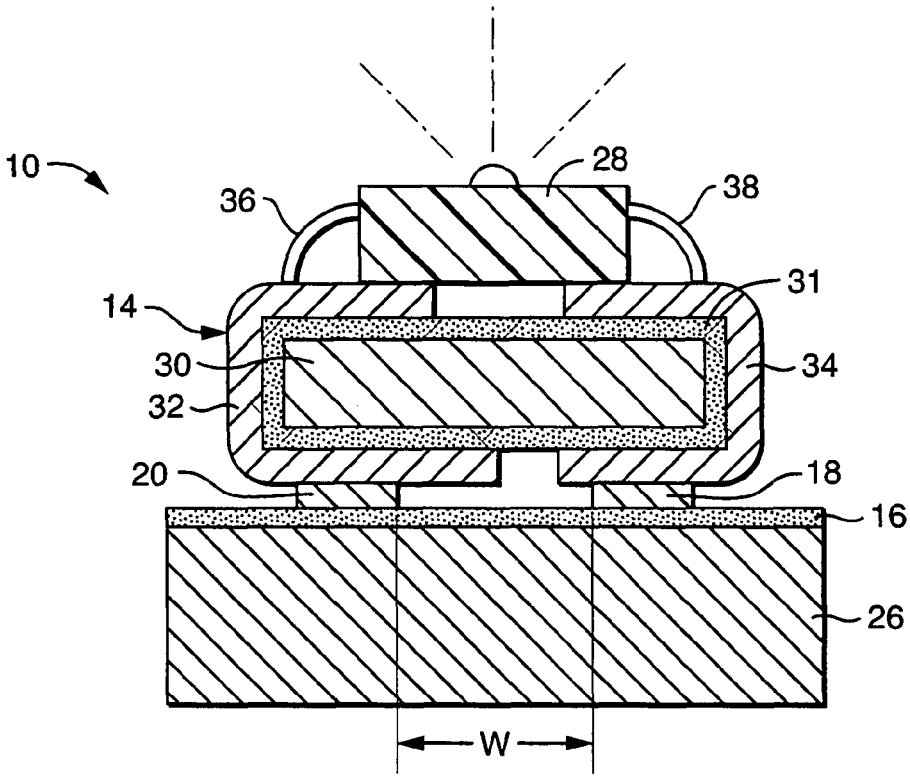
FIG. 2 is an enlarged cross-sectional view of the lighting system of FIG. 1 taken along line 2-2.
Figure 2A:
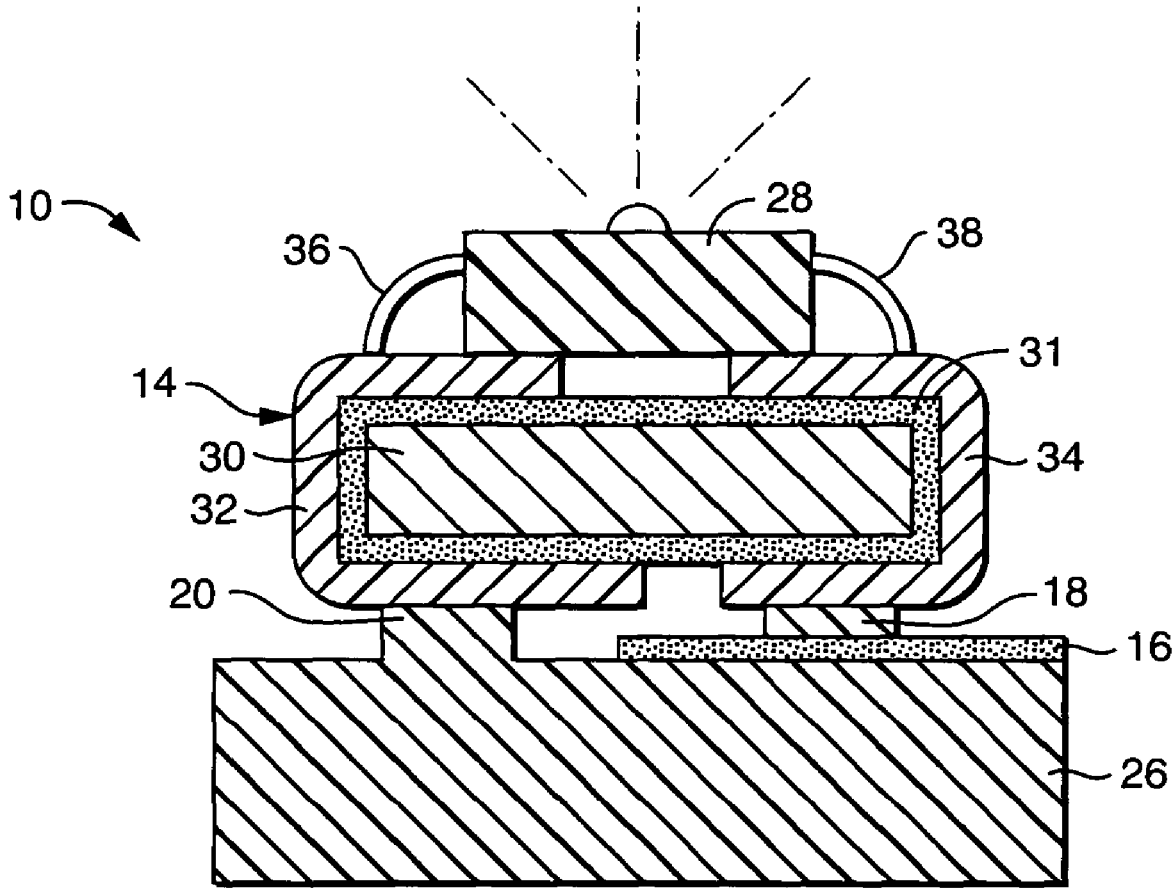
FIG. 2A illustrates the embodiment of the invention shown in FIG. 2 wherein the electrically conductive frame serves as one electrical channel.

FIG. 2 is an enlarged sectional view of lighting system 10. FIG. 2 illustrates the electrical circuit of lighting system 10. As seen in FIG. 1, electrical power from an external source is supplied across electrically conductive channels 18 and 20. FIG. 2 shows channel 18 in electrical contact with electrically conductive path 34, and channel 20 in electrical contact with electrically conductive path 32. Paths 32 and 34 connect to lead-in wires 36 and 38, respectively, of light source 28. Dielectric coating 31, e.g., an electronic grade porcelain enamel, electrically insulates paths 32 and 34 from each other and base 30. Any number of conventional dielectric or resistive coating materials, such as, for example, porcelain enamel, glass, ceramic, organic electrically insulating materials, or glass/ceramic coatings, may be used in connection with the present invention. A dielectric coating may not be required with the use of magnets having high electrical resistance, e.g., ceramic magnets. However, such magnets must also have adequate thermal conductivity for their heat-sinking function as will be discussed below. To avoid the possibility of shorting the frame channels, width w (shown in FIG. 2) between frame channels 18 and 20 should be wide enough to prevent either path 32 or path 34 from simultaneously touching both channels even if module 14 is twisted on frame 12.

Figure 3:
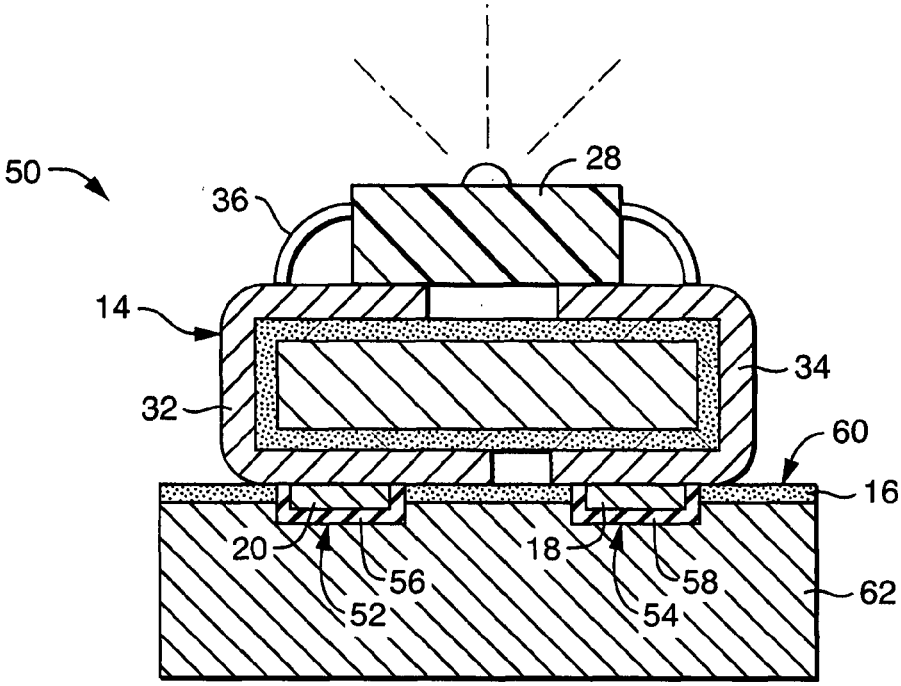
FIG. 3 is a sectional view of an alternate embodiment of the invention.

Referring now to FIG. 3, there is shown a lighting system 50 that has channels 18 and 20 located within electrically insulated grooves 52 and 54 of frame 62. Surface 60 of frame 62 may include dielectric coating 16 outside grooves 52 and 54 to prevent electrical contact of paths 32 or 34 with frame 62. Dielectric material 56 and 58 can be formed from any suitable non-conductive material that may be the same as, or different from, the material of dielectric coating 16. As discussed above, dielectric material 56 and 58 may not be required when paths 32 and 34 are electrically isolated from each other by virtue of the non-conductivity of the frame material surrounding grooves 52 and 54.

In the embodiments shown in FIGS. 1-3, light source 28 preferably is a LED. LED light modules are typically light, compact, and relatively rugged and inexpensive. LED embodiments of the invention are particularly well suited for display where the physical lighting systems are intended to be as compact and inconspicuous as possible. The frame may be thin, e.g., a thin piece of steel, with the dielectric coating located only below the electrical contacts. The light modules may have a low profile such that the overall lighting system is ideal for display applications. The frame may be formed in or by a surface of a structure, such as a shelf, display case top, underside of a cabinet, etc. In a case where a frame has insufficient interior volume, a portion or all of the electrical-support and/or control devices may be located remotely.

The optimum voltage for driving a circuit with a plurality of LED light sources will depend on the number of light sources, their characteristics and arrangement in the circuit, and other circuit components. The current may be direct or alternating depending on the application. With an LED light source, the electrical power applied across terminals 22 and 24 of FIGS. 1-3 is preferably about five volts direct current but, as will be discussed below, alternating current may be desired in some LED applications. With tungsten-halogen lamps, such as MR-16 lamps frequently employed in track lighting, the voltage applied across terminals 22 and 24 is preferably about twelve volts. In either of these low-voltage embodiments, there is no danger of electrical shock resulting from exposed electrical channels 18 and 20.

However, other types of light sources, such as incandescent, tungsten-halogen, and fluorescent lamps, are within the scope of the invention. A step-down transformer may used to reduce the voltage applied across terminals 22 and 24 where required, e.g., traditional tungsten-halogen track lighting. In high-voltage embodiments, the lighting system may be mounted in a housing with a light-transmissive cover preventing access to exposed channels 18 and 20, preferably with a kill switch that automatically shuts off the power across channels 18 and 20 when the cover is open.

Particularly in LED applications, magnetic base 30 and frame 26 are sized to function as a heat sink that conducts sufficient heat away from light module 28 to satisfy the module's thermal operating requirements. More particularly, the magnet serves as a thermal path for heat transfer to the substrate portion of the frame. The substrate is the effective heat sink.

A wide variety of LEDs in all colors suitable for use in accordance with the invention is available from Osram Opto Semiconductors Inc., 2650 San Tomas Expressway, Suite 200, Santa Clara, Calif. 95051. LEDs from the Dragon® Family are particularly well suited.

Figure 4:
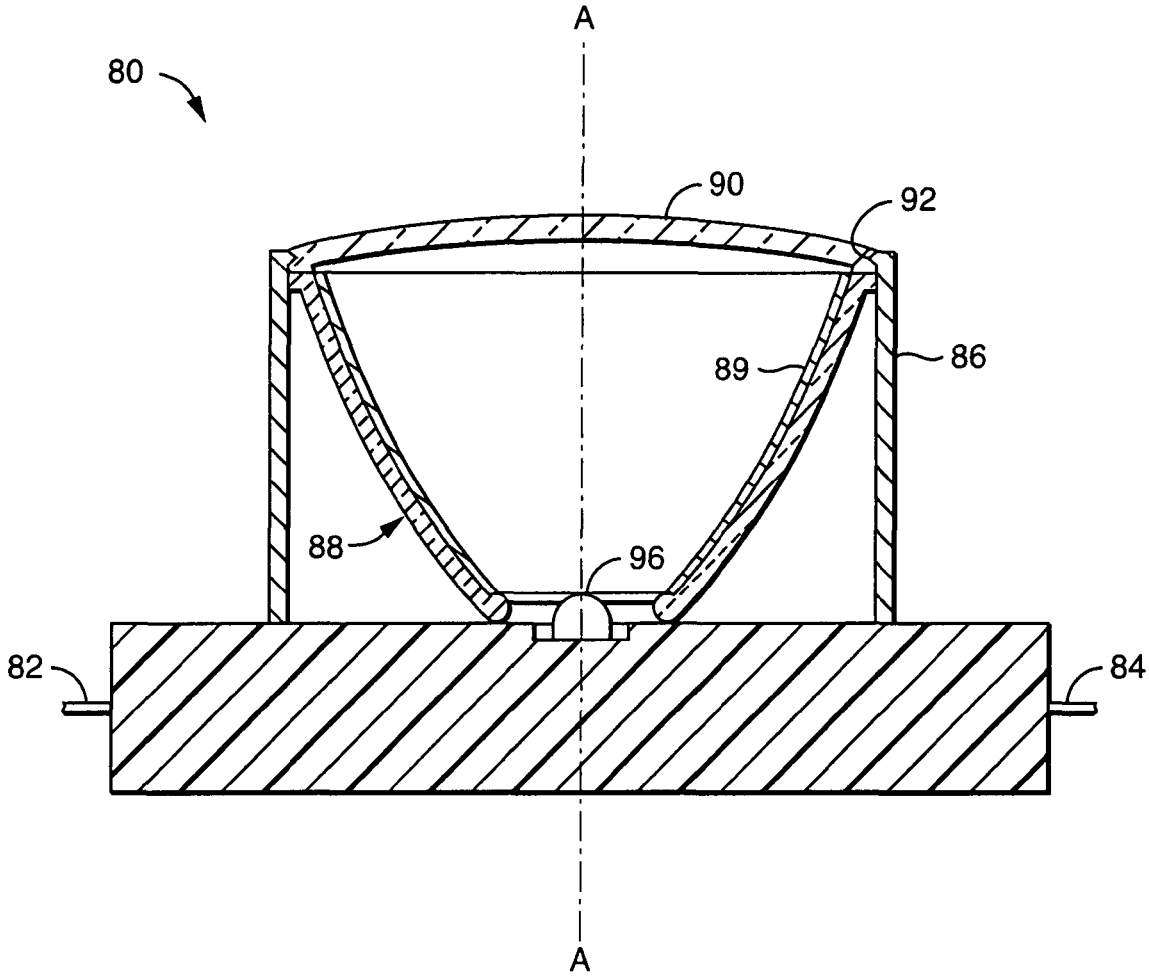
FIG. 4 is a sectional view of an alternate embodiment of a light module.

Referring to FIG. 4, an alternate embodiment of a light source is shown. Light source 80 of FIG. 4 may be substituted for light source 28 of FIG. 1 by electrically connecting lead-in wires 82 and 84 to channels 32 and 34, respectively. Light source 80 includes cylindrical sleeve 86 having central axis A-A. Reflector 88, also with central axis A-A, is mounted within sleeve 86. Reflector 88 may be parabolic, as shown in FIG. 4, or some other shape in order to obtain a desired beam pattern. Reflector 88 typically has light-reflective coating 89 on its inside surface. Lens 90 may be removably mounted on sleeve 86 by suitable means, e.g., by thread 92 such that lens 90 may be screwed into sleeve 86 in front of light LED 96 or by being pushed onto two spade posts. As is well known in the art, lens 90 may be shaped, patterned, and/or coated to produce various characteristics of light emitted from light source 80. Further, lens 90 may be colored to match or be different from the color of the light emitted from light source 80. Lens 90 may be opaque or semi-opaque everywhere except for the outline of an alphanumeric character or some other symbol such that light source 80 projects the image of such character or symbol when the light source is lit. Because lens 90 is replaceable, the character or effect of the light emitted from light source 80 may be changed by replacing lens 90 with a different lens. In FIG. 4, light source 80 employs LED 96 as the light-generating device, but a different light-generating source may be employed. In an alternate embodiment of the invention (not shown in the drawings), reflector 88 may be movably mounted on the light module such that the direction of the emitted beam may be adjusted without relocating the light module on the frame. See, for examples, U.S. Pat. No. 5,154,509, issued on Oct. 13, 1992, to Wulfman et al. (mentioned above) and U.S Pat. No. 4,719,549, issued Jan. 12, 1988, to Apel.

Figure 5:
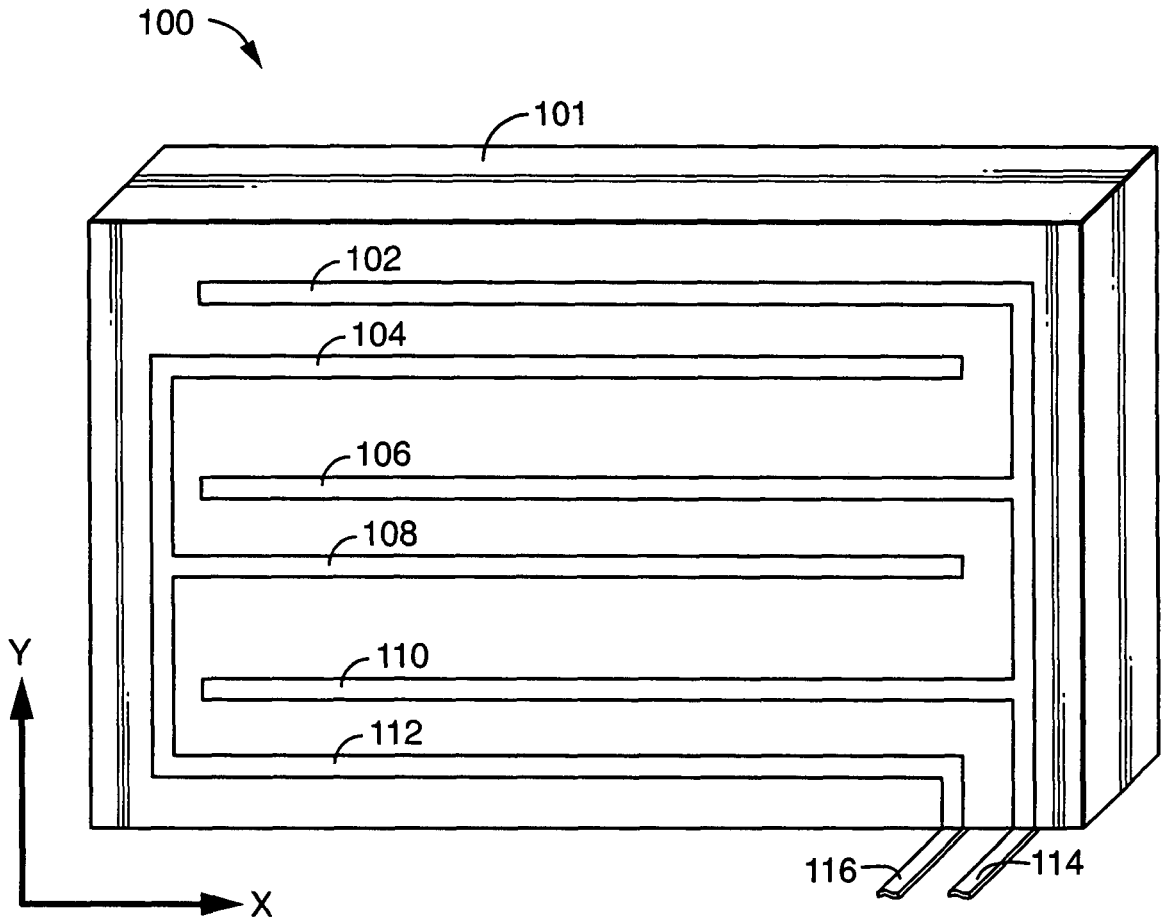
FIG. 5 is a pictorial view of a frame for a lighting system.

FIG. 5 is a pictorial view of a frame 100 for use with one or more light modules in accordance with various aspects of the invention. Frame 100 differs from frame 12 of FIG. 1 in that there is a plurality of pairs of electrically conductive channels on which one or more light modules may be magnetically mounted. In the drawing, channels 102 and 104 form a first channel pair, channels 106 and 108, a second pair, and channels 110 and 12, a third pair. If desired, additional pairs of channels may be added to frame 100. Each channel may be formed from a thin electrically conductive material and mounted on body 101 covered with a dielectric coating as shown in FIG. 2, or each channel may be mounted in an insulated groove in body 101 as shown in FIG. 3. Terminals 114 and 116 may be connected to an external source of electrical power. The electrically conductive channels, and/or channel pairs, may be fabricated by printed circuit board techniques. In an embodiment such as shown in FIG. 5, there is the advantage that a plurality of light modules may be mounted on the frame substantially in the form of an array, i.e., an arrangement of rows and columns in the x- and y-directions.

Frame 100 may have a variety of embodiments and applications. In a vertical orientation as depicted in FIG. 5, frame 100 may be used as a fixture for signage. Light modules with alphanumeric lenses may be mounted on frame 100 so as to display a message. When mounted horizontally with the channels facing down under a counter or in a display case, frame 100 accommodates a flexible arrangement of light modules, positionable in both x- and y-directions, to direct light onto a particular work area or areas, or to highlight certain merchandise, perhaps with different light intensities, colors, or aesthetic effects.

Figure 12:
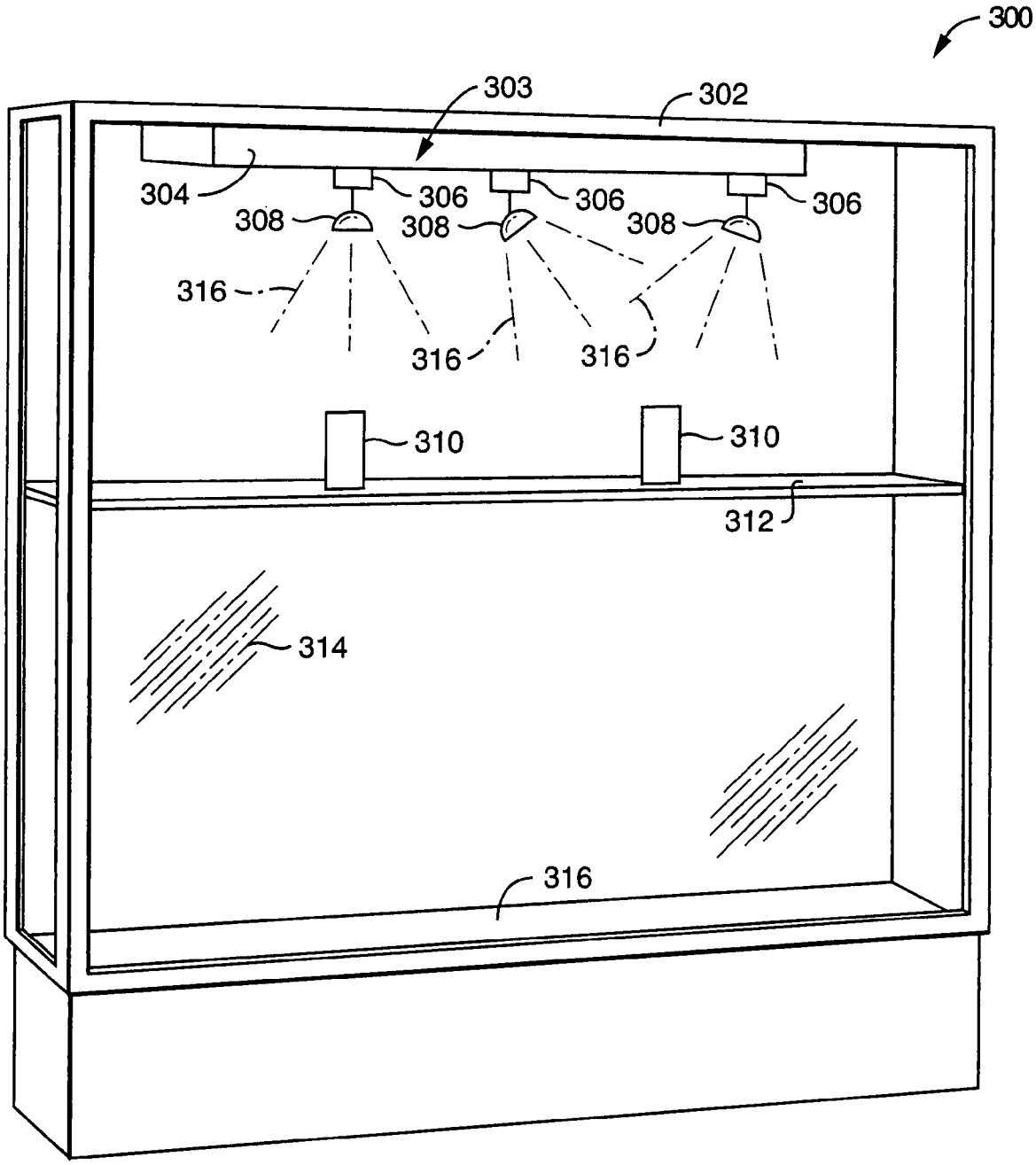
FIG. 12 is a pictorial view of an embodiment of the invention mounted in a display case.

FIG. 12 illustrates an embodiment of the invention mounted in display case 300. Display case 300 has lighting system 303 mounted on the underside of top shelf 302. Objects 310 situated on shelf 312 are objects to be displayed through glass front 314. Light modules 306 are mounted on frame 304 so as to illuminate objects 310 favorably. There is a good deal of flexibility in the positioning of modules 306. As discussed with reference to FIG. 5, the modules may be mounted in various positions in both the x- and y-directions of the horizontal shelf. As described with reference to FIG. 4, reflectors 308 are adjustably mounted on modules 306 such that light beams 316 may be directed to illuminate objects 310 at a desired angle, and various characteristics of the emitted light may be obtained by the choice of lenses (if any) used on reflectors 308. An additional lighting system 303 may be mounted on the underside of shelf 312 if objects placed on shelf 316 are desired to be illuminated.

Returning to FIG. 5, frame 100 may be employed as a multiple track-lighting fixture mounted on a ceiling or wall. Frame 100, preferably with a diffusive and protective cover, may be used as a ceiling light fixture. In rooms with suspended ceilings, frame 100 may be adapted to fit into the ceiling grid in place of a ceiling panel. Moreover, several frames 100, of the same or different sizes, may be used together as building blocks or components to construct a two- or three-dimensional lighting system, e.g., a two-dimensional system in the shape of the letter "E," or a three-dimensional system in the shape of a cube or parallelepiped, or combinations of same, with light modules mounted on some or all faces.

Figure 6:
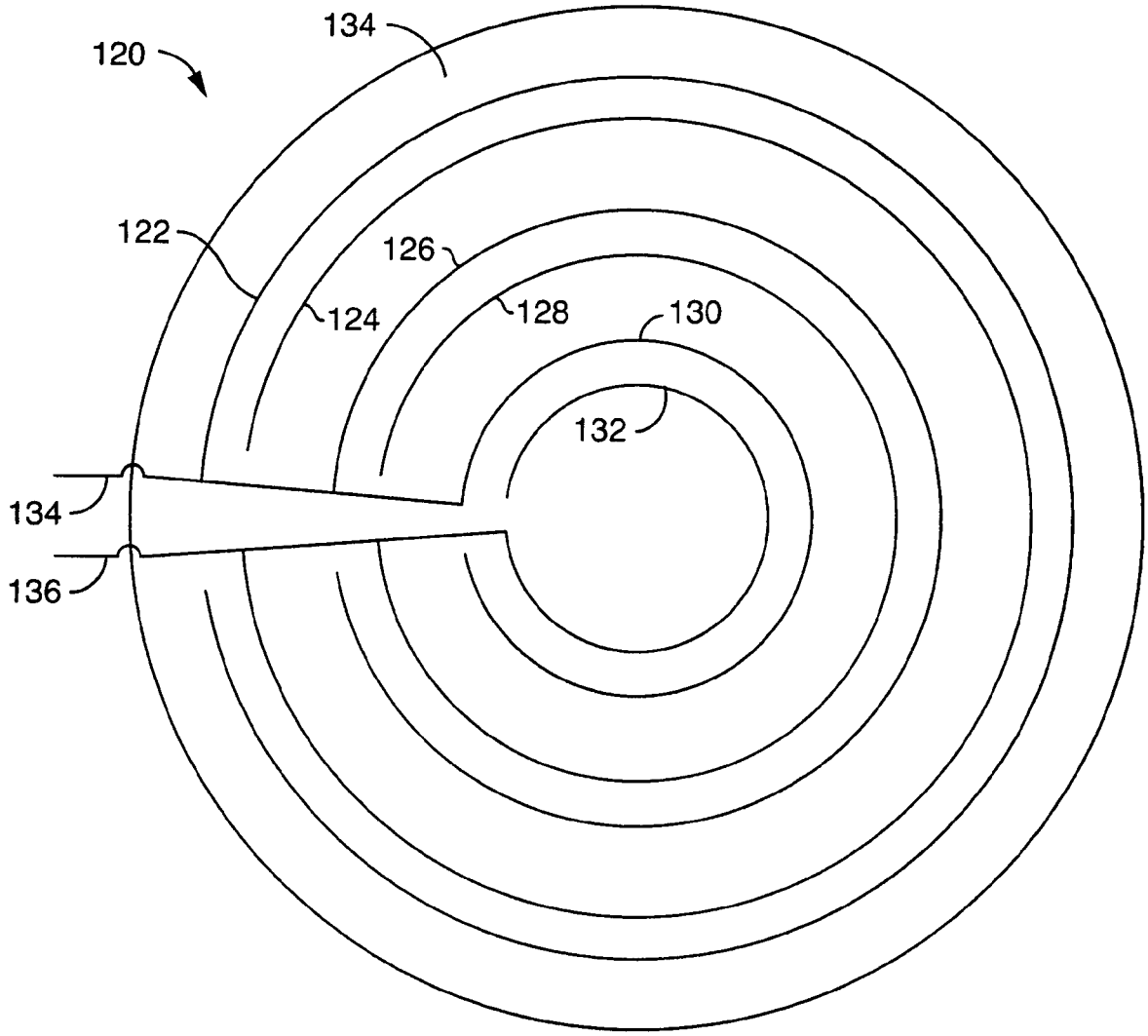
FIG. 6 is an elevational view of a circular frame for a lighting system.

A frame need not be rectangular. FIG. 6 shows an elevational view of a circular frame 120 based on the same wiring and insulating principles as frame 100. In FIG. 6, each electrically conductive channel is represented by a single line, rather than a double line as in FIG. 5, to illustrate the electrical circuit more clearly. The drawing shows three pairs of channels, 122 and 124, 126 and 128, and 130 and 132, that are essentially arranged on concentric circles on dielectric surface 134 of frame 120. When terminals 134 and 136 are energized with suitable electrical power, one or more light modules may be operatively mounted on one or more channel pairs. In a variation of the embodiment of FIG. 6, a single pair of channels is arranged in a spiral on the circular frame rather than in a pattern of concentric circles. It is within the scope of the invention to modify frame 120 and the channels on its surface by stretching their circular shapes into various other shapes, such as an oval, crescent, etc.

Figure 7A:
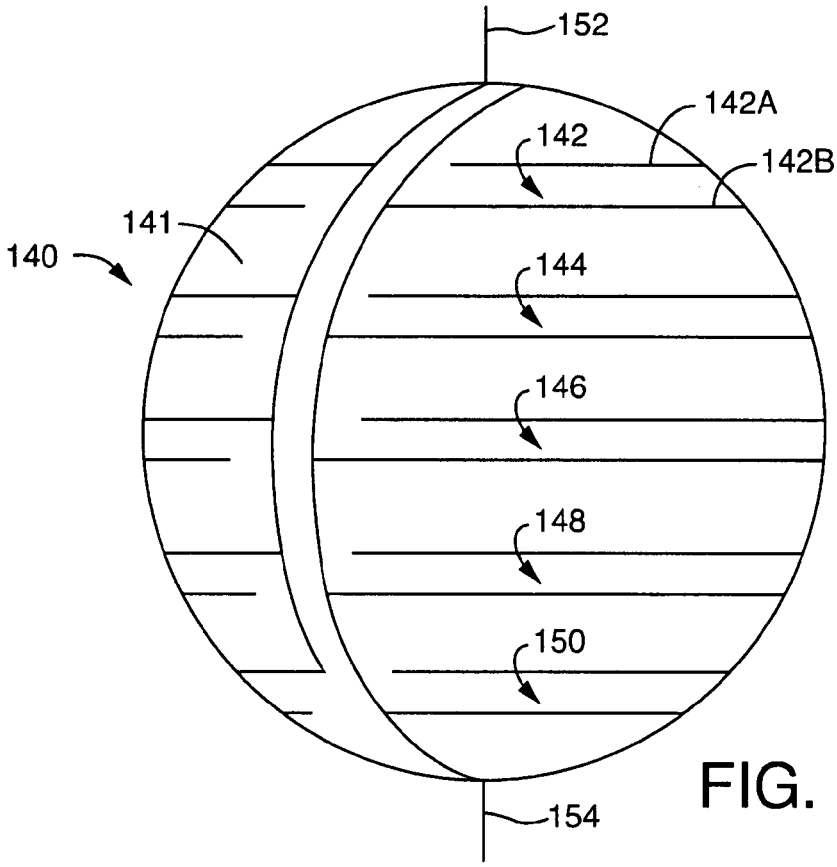
FIG. 7A is an elevational view of a spherical frame for a lighting system.

Aspects of the invention are applicable also to three dimensions. FIG. 7A depicts an elevational view of spherical frame 140 based on the same wiring and insulating principles as frame 100 of FIG. 5. As in FIG. 6, the electrically conductive channels in FIG. 7A are shown as single lines. Channel pair 142 comprises channels 142A and 142B; likewise, channel pairs 144, 146, 148, and 150 are each comprised of two channels. In this embodiment, the electrical circuit is located entirely on the dielectric surface 141 of sphere 140. Channel pairs 142, 144, 146, 148, and 150 are substantially latitudinal circles of sphere 141. The circuit may be energized by connecting terminals 152 and 154 to a suitable power source.

In order to mount light modules on spherical frame 140, the frame surface must be substantially flat. The term "substantially flat" as used herein with respect to a frame surface means that the frame surface either is flat or has a radius of curvature large enough to permit light modules to be mounted on the frame surface by magnetic attraction without slippage or rocking. The distance between channels of each channel pair should be small enough so that reliable electrical and thermal contact occurs between the channels and corresponding paths of a mounted light module. To facilitate reliable electrical and thermal contact between frame channels and the corresponding paths of a mounted light module, the surface of the light module may be curved to match or accommodate the curvature of the frame. The term "substantially flat" as used herein with respect to a module surface means that the module surface may be either flat or curved such that the module may be mounted on the frame surface by magnetic attraction without slippage or rocking, although the curvatures of the frame and module surfaces need not be identical. Further, the frame channels may be raised from the surface of the frame, as shown in FIG. 2, and/or the module's paths may be raised from the body of the module. Additionally, the module may include spring contacts, typically formed from beryllium copper, that may be shaped to conform to the curvature of the frame. Spring contacts will enhance heat transfer away from the module and improve module stability particularly where the path/channel contacts between the module and frame are narrow. By using a judicious combination of the aforementioned techniques, a light module may be designed such that it can be magnetically mounted securely on a frame even when the surface of the frame is curved.

While FIG. 7A depicts a spherical frame, the same principles apply to a cylindrical or conical frame and other curved three-dimensional frames. Particularly in three dimensional embodiments of the invention, it may be advantageous to conserve weight by employing a frame comprising non-magnetic material, such as plastic, with pieces of magnetic material imbedded in the frame or adhered on the inside of the frame. In such embodiments, however, the mass of the imbedded magnetic material must be large enough to satisfy the heat-sinking function and, as is the case in all embodiments of the invention utilizing the heat-sinking ability of the magnetic materials, the size of the contact areas between the frame and module must be sufficient to permit adequate heat transfer from the module to the frame.

Figure 7B:
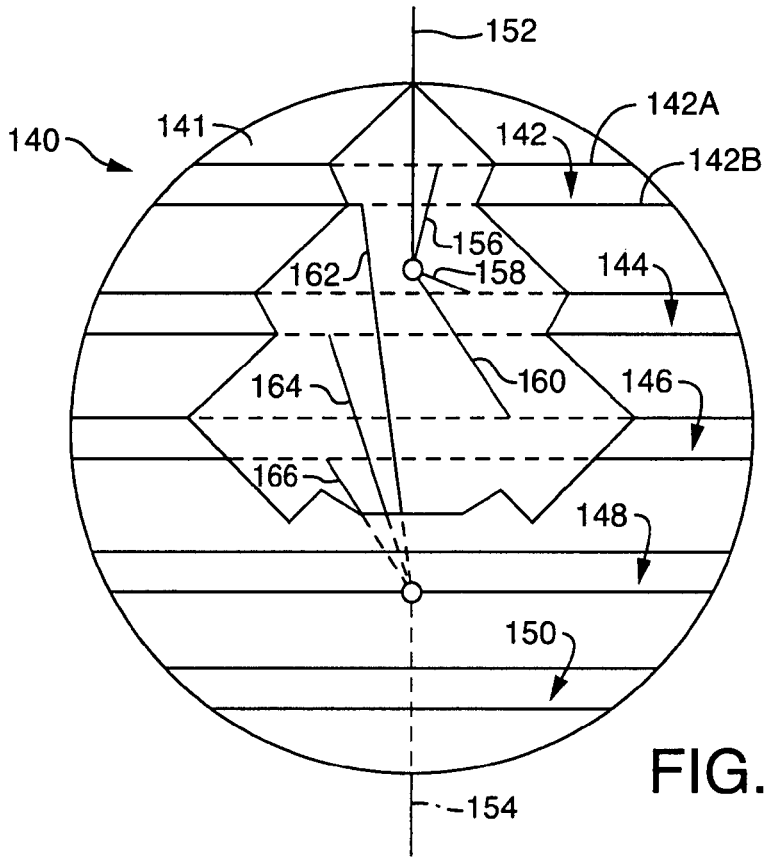
FIG. 7B is an elevational view of a spherical frame for a lighting system with a portion of the spherical surface cut away.

FIG. 7B shows the same spherical frame 140 except that the channel pairs 142, 144, 146, 148, and 150 are full latitudinal circles on dielectric surface 141 of sphere 140. In this embodiment, terminals 152 and 154 protrude into the interior of frame 140. Looking through the break-away in the drawing, terminal 152 is electrically connected to the first channel of each channel pair as illustrated by connecting wires 156, 158, and 160. Terminal 154 is electrically connected to the second channel of each channel pair as illustrated by connecting wires 162, 164, and 166. Additional connecting wires to the remaining channels are omitted in FIG. 7B for clarity. It is within the scope of the invention to modify frame 140 by stretching it into various other shapes, such as an ellipsoid, etc. In a variation of the embodiment of FIG. 7A, a single pair of channels forms a spiral over the surface of sphere 141, running essentially from the north pole to the south pole. The embodiments of FIGS. 7A and 7B are typically used in lighting systems hung from a ceiling or mounted on a pole-type base. For a lighting system mounted directly on a horizontal or vertical surface, half of frame 140, i.e., a hemisphere, may be employed using the same principles illustrated in FIGS. 7A and 7B.

FIG. 7B illustrates the concept that electrical power may be supplied to the frame channels from inside the frame of the lighting system. Various electrical control devices, such as ballasts, dimmers, transformers, power supplies, inverters, drivers, controllers, etc., may also be located within the body of the frame such that the lighting system may be connected directly to a standard power source, say, 110 volts, alternating current. Moreover, such control devices may each service one or more light modules, such as one ballast servicing four or eight fluorescent light modules. This feature of the invention may be employed with three-dimensional frames, e.g., a cube, sphere, or polyhedron, and it may also be utilized with two-dimensional frames, such as those depicted in FIGS. 1, 5, and 6, by extending the electrical channels to the inside of the frame bodies rather than directly to external terminals as shown in the drawings.

Figure 8A:
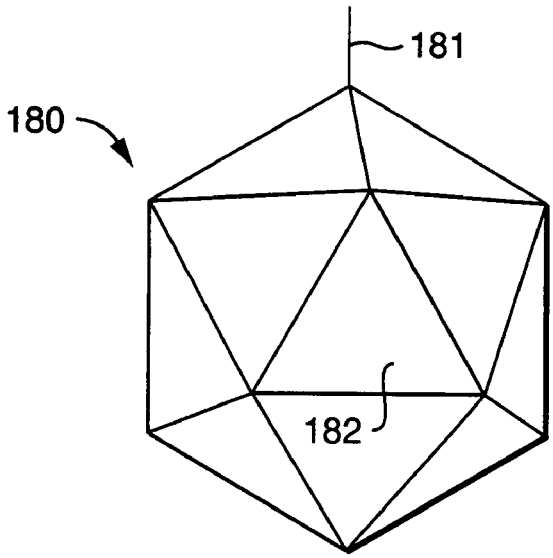
FIGS. 8A and 9A are isometric views of solid frames for a lighting system in the shapes of an icosahedron and a dodecahedron, respectively.
Figure 8B:
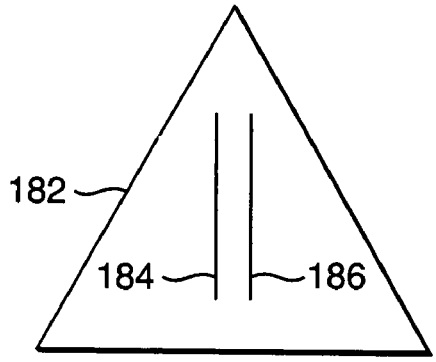
FIG. 8B is an elevational view of one triangular face of FIG. 8A.
Figure 9A:
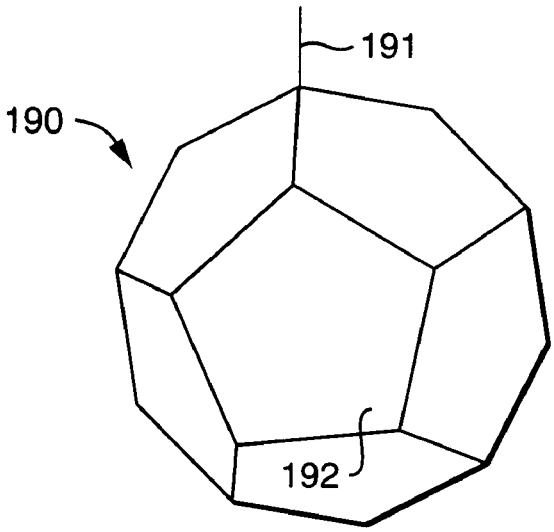
Figure 9B:
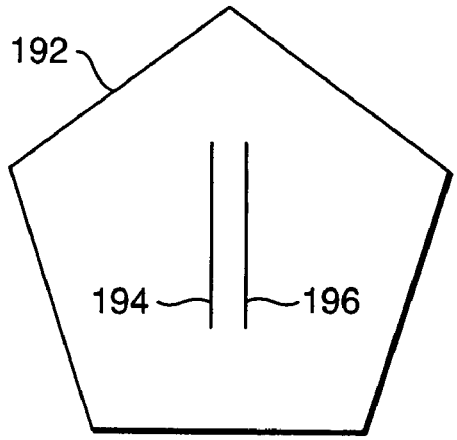
FIG. 9B is an elevational view of one pentagonal face of FIG. 9A.

In further aspects of the invention, FIGS. 8A and 9A illustrate additional examples of embodiments of three-dimensional frames. FIG. 8A illustrates an icosahedron frame 180 having twenty equal faces 182, each face being an equilateral triangle as shown in FIG. 8B. Terminal 181, comprising dual electrically isolated wires, extends inside the body of frame 180 and provides means for supplying electrical power to light modules from within frame 180. FIG. 9A illustrates a dodecahedron frame 190 having twelve equal faces 192, each face being an equilateral pentagon as shown in FIG. 9B. Terminal 191, comprising dual electrically isolated wires, extends inside the body of frame 190 and provides means for supplying electrical power to light modules from within frame 190. As shown in the drawings, electrically conductive channels 184 and 186 may be centrally located on dielectric-coated triangular face 182, and likewise for electrically conductive channels 194 and 196 on dielectric-coated pentagonal face 192, although the orientation of these channels within the triangular or pentagonal faces is not critical. Faces 182 and 192 comprise magnetic material so that a light module may be mounted on each face. Channels 184 and 186 are electrically isolated from each other and from face 182, and likewise for channels 194 and 196 from face 192. Channels 184 and 186 pass through face 182 and are connected to terminal 181 such that electrical power may be supplied from inside the body of icosahedron frame 180 in the same way as shown in FIG. 7B, and likewise for channels 194 and 196 from inside dodecahedron frame 190.

Additional solid shapes for frames in accordance with various aspects of the invention, such as cylinders, cones, prisms, combinations and frustums of various solids, etc., may be constructed by one with skill in the art using the same principles as described above. These additional embodiments are within the scope of the invention.

Figure 10:
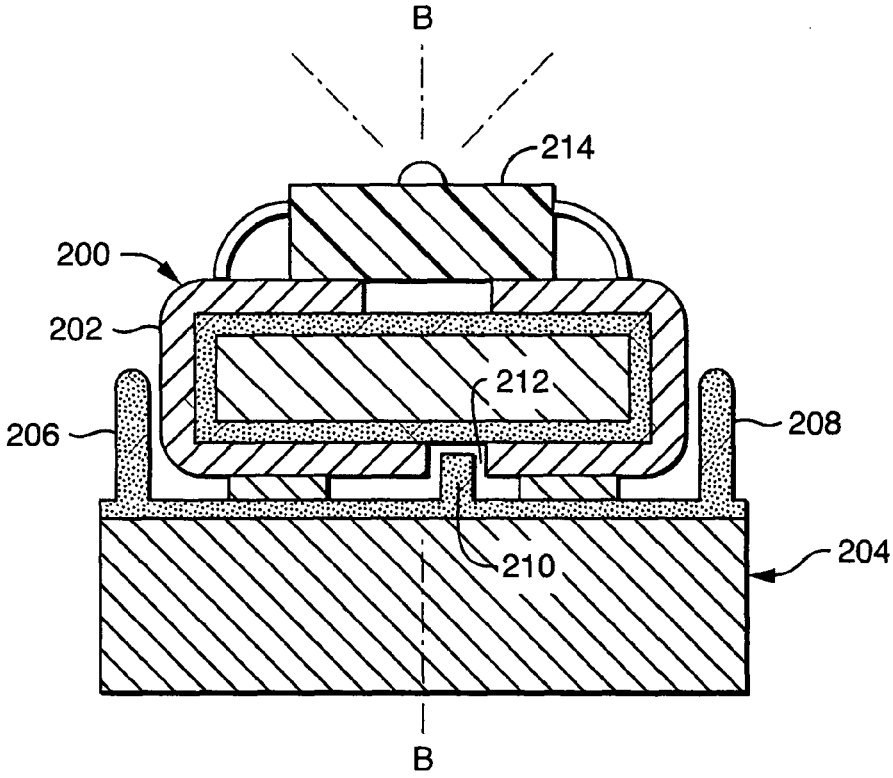
FIG. 10 is a cross-sectional view of an alternate embodiment of a lighting system with means for aligning the light module on the frame.

As described in the foregoing examples, numerous embodiments and variations of the frame structure are possible and practical. In all of these embodiments, it is important that the electrical paths of the light module be properly positioned on the electrical channels of the frame so that the light module can be reliably powered. Pictorials or graphics may be employed to provide guidance as to the proper orientation of modules on the frame. FIG. 10 shows the lighting system of FIG. 2 with the addition of ridges 206, 208, and 210 and receiving groove 212. Assuming, for the moment, that ridge 210 and groove 212 are omitted, ridges 206 and 208 insure that light module 200 is properly aligned electrically when mounted on frame 204 except, possibly, for electrical polarity. With ridge 210 positioned within groove 212, proper polarity is assured because the ridge and groove, both located to the right of center-line B-B in the drawing, are not centered on frame 204. Note, ridge 210 and groove 212 may not always be necessary or desired as, for example, where the light module 200 is powered by alternating current.

In a direct-current embodiment where light source 214 is an LED and ridge 210 and groove 212 have been omitted, a user would realize that the light module was mounted with improper polarity by virtue of the fact that the LED did not light when energized, whereupon the user would remount the light module with the polarity reversed. Alternatively, the light module may include two LEDs, each lighting with opposite polarity, so whatever the polarity of the module one LED would light. A light module with two LEDs of opposite polarity will function with alternating current. Another dual-LED alternative is where each LED emits different colored light, say, the first LED emitting white light and the second, with opposite polarity, emitting red light. Emitted red light might signal the user that the light module is mounted with the wrong polarity, or it may be a design feature of the light module that it can emit different colored light depending on its polarity position on the frame or depending on the polarity supplied to the lighting system. The latter case may be employed in a signaling system, because the color of the emitted light, e.g., red or green, could be changed by reversing the polarity supplied to the lighting system. Additional signaling options, such as blinking, could be achieved by pulsing the power supplied to the lighting system. A single light module may be comprised of two groups of LEDs with one group responding to a first applied polarity and the second group responding to the opposite applied polarity or, alternatively, a lighting system may employ two groups of light modules, one group of modules responding to a first polarity and the second group of modules responding to the opposite applied polarity.

Figure 11:
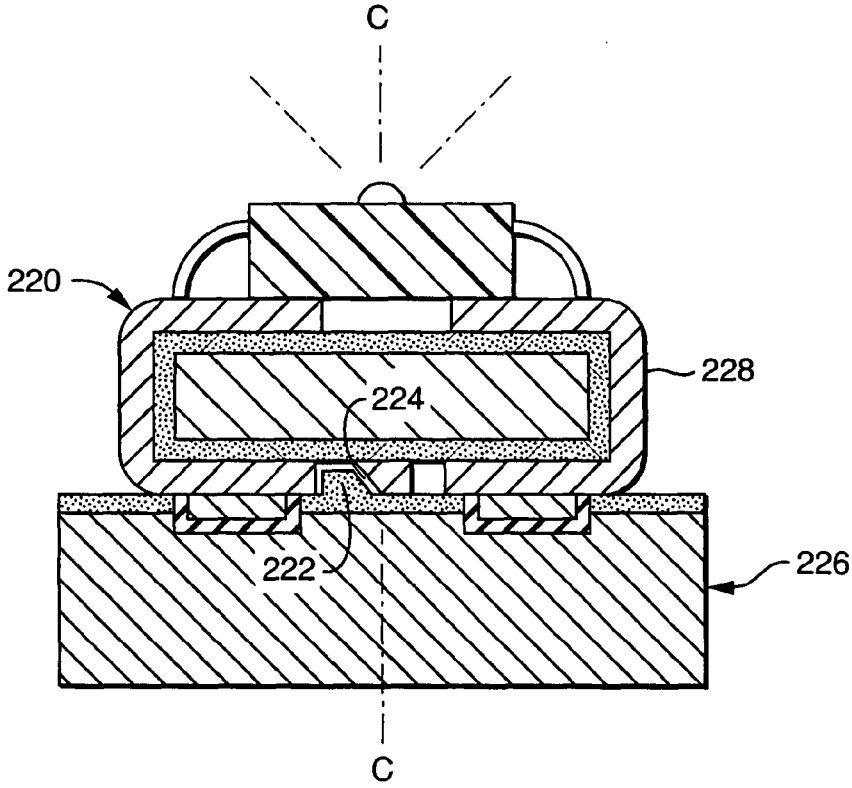
FIG. 11 is a cross-sectional view of another alternate embodiment of the lighting system with means for insuring proper alignment and electrical polarity of the light module on the frame.

FIG. 11 shows the lighting system of FIG. 3 with the addition of ridge 222 on frame 226 and matching groove 224 in light module 228. Ridge 222 is asymmetrical, having one vertical side (left side in the drawing) and one slanted side (right side in the drawing), and likewise for matching groove 224. Mounting module 228 on frame 226 with ridge 222 properly positioned within groove 224 insures reliable electrical contacts and proper polarity, irrespective of whether or not groove is centered with respect to center-line C-C. There are numerous other possible arrangements of ridges, grooves, and/or other means in accordance with various aspects of the invention for insuring the light module will be mounted on the frame with reliable electrical contacts between the module and frame and, where appropriate, proper electrical polarity.

In each of the foregoing embodiments of the invention, there is the capability for a variable number of light modules to be electrically connected in parallel on a frame connected to an external power supply or driver circuit. Because the light modules may be added or removed from the frame at any time, the power supply must be capable of regulating the supply current such that an appropriate current will be provided to each light module. Such regulated power supplies are known in the art. See, for example, U.S. Pat. No. 6,577,512, issued Jun. 10, 2003, to Tripathi et al., which describes a power supply for a variable number of LEDs wired in series or in parallel.

In an embodiment employing a variable number of LED light modules connected in parallel, the driver circuit may need the ability to detect the number of light modules mounted on the frame in real time. A resistor added in parallel with the LED on each module will facilitate the driver circuit's ability to detect the number of LED light modules mounted at any time. By periodically detecting the equivalent resistance of the mounted LED modules, the driver circuit would regulate the supply current accordingly.

Referring again to the above-mentioned Wulfman et al. patent, the present invention may be employed in low- or high-voltage applications with LED, incandescent, quartz-halogen, or fluorescent light sources, whereas Wulfman et al. teaches only a low-voltage quartz-halogen system. A frame of the present invention may be adapted to support light modules in one, two, or three dimensions, whereas the Wulfman et al. housings are constrained to a linear track. An advantage of the present invention not taught by Wulfman et al. is the feature that the magnetic materials in the frame and light module serve the dual purpose of mounting and heat-sinking in LED embodiments. In applications where it is desirable to have the lighting system be as inconspicuous as possible such as an under-counter system for lighting merchandise, the bracket and fixtures of Wulfman et al. will occupy significantly more space and be more conspicuous than a lighting system in accordance with the invention, particularly in an embodiment employing LED light sources. There are further advantages. The present invention may be employed in signage or signaling applications. Lighting systems in accordance with the present invention may be used as components or building blocks in larger lighting systems. Lighting systems in accordance with the present invention may be fabricated with three-dimensional frames that have an aesthetic appearance even when the lighting system is not illuminated. The present invention has a far wider variety of applications than the lighting system of Wulfman et al. and provides a user with enhanced ability to control the quantity, direction, and characteristics of the emitted light.

While there have been shown what are at present considered to be the preferred embodiments of the invention, it will be apparent to those skilled in the art that various changes and modifications can be made herein without departing from the scope of the invention as defined in the appended claims. Accordingly, it should be understood that the invention has been described by way of illustration and not limitation.

The invention claimed is:

1. A lighting system with removable light modules comprising:

(a) a frame having a substantially flat surface, said frame including a magnetic material and first and second electrically conductive channels mounted on said surface such that said channels are electrically isolated from each other;

(b) a light module comprising an LED light source having sufficient lumen output for use in general lighting applications mounted on a base, said base having a top surface and a substantially flat bottom surface with a dielectric coating covering said top and bottom surfaces and a magnetic material between said top and bottom surfaces, first and second electrically conductive paths mounted on said top dielectric surface such that said paths are electrically isolated from each other, said LED light source having first and second electrically conductive lead-in wires electrically connected to said first and second paths, respectively, and said magnetic material of said base and said magnetic material of such frame providing adequate heat-sink means for the thermal operating requirements of said LED light source; and (c) said light module being mounted on said frame with said substantially flat bottom surface of said light module facing said substantially flat surface of said frame, said first path of said light module being in electrical contact with said first channel of said frame and electrically isolated from said second channel, said second path of said light module being in electrical contact with said second channel of said frame and electrically isolated from said first channel, said light module being securely mounted on said frame by means of a magnetic attractive force acting between said magnetic material of said light module and said magnetic material of said frame and such that said magnetic attractive force permits said light module to be manually removed from said frame.

2. A lighting system as described in claim 1 wherein said first and second electrically conductive paths of said light module are thin electrically conductive strips.

3. A lighting system as described in claim 1 wherein said substantially flat surface of said frame has a dielectric coating thereon and said first and second channels are mounted on said dielectric coating of said frame.

4. A lighting system as described in claim 1 wherein said frame includes means for insuring proper electrical polarity between said first and second electrically conductive channels of said frame and said first and second electrically conductive paths of said base of said light module.

5. A lighting system as described in claim 1 wherein said lighting system includes a plurality of light modules mounted on said frame.

6. A lighting system as described in claim 1 wherein said lighting system includes a plurality of electrically conductive channel pairs.

7. A lighting system as described in claim 1 wherein said frame has a substantially three-dimensional shape.

8. A lighting system as described in claim 1 wherein said light module emits colored light.

9. A lighting system as described in claim 1 wherein said lighting system includes an electrical control device servicing said module, said electrical control device being located within the body of said frame.

10. A lighting system as described in claim 1 wherein said lighting system includes first and second LEDs and the polarity of the first LED is opposite to that of the second LED.

11. A lighting system with removable light modules comprising:

(a) a frame having a substantially flat surface, said frame including a magnetic material and first and second electrically conductive channels mounted on said surface;

(b) a light module comprising a light source mounted on a base, said base having a substantially flat surface, said base including a magnetic material and first and second electrically conductive paths, said light source having first and second lead-in wires electrically connected to said first and second electrically conductive paths of said base;

(c) said light module being mounted on said frame with said substantially flat surface of said light module facing said substantially flat surface of said frame and said first path of said light module being in electrical contact with said first channel of said first frame and electrically isolated from said second channel and said second path of said light module being in electrical contact with said second channel of said second frame and electrically isolated from said first channel such that said light module is securely mounted on said frame by means of a magnetic attractive force acting between said magnetic material of said light module and said magnetic material of said frame and such that said magnetic attractive force permits said light module to be manually removed from said frame; and a housing enclosing said frame and said light module, said housing including an openable light-transmissive cover that when closed prevents access to said first and second electrically conductive channels and a kill switch responsive to the position of said cover such that the electrical power flowing through said channels is shut off when said cover is open.

12. A lighting system as described in claim 11 wherein said light source is a fluorescent lamp.

* * * * *